US008193447B2

(12) United States Patent
Peckham

(10) Patent No.: US 8,193,447 B2
(45) Date of Patent: Jun. 5, 2012

(54) ELECTRICAL OUTLET PLATE CONTROL ARRANGEMENT

(76) Inventor: Albert E. Peckham, Gloucester, MA (US)

( * ) Notice: Subject to any disclaimer, the term of this patent is extended or adjusted under 35 U.S.C. 154(b) by 250 days.

(21) Appl. No.: 12/800,451

(22) Filed: May 14, 2010

(65) Prior Publication Data

US 2011/0070756 A1 Mar. 24, 2011

Related U.S. Application Data

(63) Continuation-in-part of application No. 12/586,524, filed on Sep. 23, 2009, now Pat. No. 8,115,100.

(51) Int. Cl.
*H01R 13/14* (2006.01)

(52) U.S. Cl. ..... 174/67; 174/50; 439/135; 248/906

(58) Field of Classification Search ..... 174/67, 174/50; 439/135, 136, 535; 248/906; 220/4.02
See application file for complete search history.

(56) References Cited

U.S. PATENT DOCUMENTS

| | | | | |
|---|---|---|---|---|
| 2,462,756 | A * | 2/1949 | Leopold | 439/135 |
| 4,603,932 | A * | 8/1986 | Heverly | 439/147 |
| 4,851,612 | A * | 7/1989 | Peckham | 174/67 |
| 8,101,861 | B1 * | 1/2012 | Shotey et al. | 174/67 |

* cited by examiner

*Primary Examiner* — Dhirubhai R Patel
(74) *Attorney, Agent, or Firm* — Don Halgren

(57) ABSTRACT

A securement housing arrangement for attachment to a base-plate frame arrangement having electrical outlets arranged therewithin, to protect and control the use of electrical plugs in those outlets and power cables with respect to that securement housing, comprising: a wall of the housing having at least one opening for the passage of a power cable therethrough; a biasable locking lever arranged on a wall of the housing so as to secure the housing to a base plate frame arrangement, and to permit that locking lever to be controllably secured to that enclosure housing.

18 Claims, 13 Drawing Sheets

104
100

52
50
102
PRESS
118
106
108
26
34
44
130
128

ELECTRICAL OUTLET PLATE CONTROL ARRANGEMENT

This invention relates to an arrangement to enclose electrical outlet plates by an interchangeable enclosure housing, permitting various degrees of outlet plate control, and is a continuation-in-part application of U.S. application Ser. No. 12/586,524, filed Sep. 23, 2009 now U.S. Pat. No. 8,115,100, incorporated herein by reference, in its entirety.

BACKGROUND OF THE INVENTION

1. Field of the Invention

Electrical outlets may be dangerous to small children when access to those electrical outlets is left available to them. Those electrical outlets may also often be available for use by the general public for the operation of their personal communication devices, laptops and various other electrical equipment. The property owner where these electrical outlets may be arranged may however, not wish to have these electrical outlets available for use by just anyone, such as small children, travelers or people just looking for free electricity.

2. Discussion of Prior Art

In many public places, electrical and/or data outlets are merely taped over rather than being electrically disconnected, removed and blanked off, probably to avoid the time and cost of an electrician and the possible future need to restore functionality to the box.

My earlier U.S. Pat. No. 4,851,612, issued on 25 Jul. 1989, incorporated herein by reference, disclosed an outlet protector, which showed an enclosure attachable to an electrical outlet cover plate, to provide a safety enclosure for plugs mated to outlets within the cover plate.

It is an object of the present invention to improve upon the functionality and structure of the prior art.

It is a further object of the present invention to provide a safe enclosure arrangement for an electrical outlet.

It is yet a still further object of the present invention to provide an enclosure arrangement for an electrical outlet which may be locked.

It is yet another object of the present invention to provide an enclosure arrangement which may be safely tethered to an electrical outlet while that electrical outlet is being engaged.

It is yet another object of the present invention to provide an enclosure arrangement which may easily and inexpensively monitor, signal an alarm and/or record interruption of electrical power to the electrical outlet to which the enclosure is attached.

BRIEF SUMMARY OF THE INVENTION

The present invention comprises an enclosure arrangement for an electrical outlet plate so as to permit the safe control, monitoring, and alarm signaling if necessary, over its use and to prevent the misuse thereof. The enclosure arrangement preferably comprises a rectilinear, unitary housing, having a front wall, a rear wall, a left and a right sidewall and preferably, an uppermost surface. The housing is somewhat similar to that as described in my aforementioned '612 patent, except that it does not have the tabs (49, 50 and 51) on the front wall (44) as shown in the '612 patent, and other structural and functional features described hereinbelow. The housing of the present invention has, amongst other features, an inwardly displaceable, generally "T" shaped locking lever arranged to permit the housing to be secured the electric outlet baseplate and to facilitate monitoring thereof.

The generally T-shaped locking lever has a right arm with a lever axis extending from a front face thereof. A pivot square is fixedly attached to the distal end of the lever axis. The locking lever has a left arm with a lock ring or hasp extending from the front face thereof. The hasp or lock ring has a bore extending therethrough. The locking lever has a central leg member extending perpendicularly from the left arm and the right arm. The lower or distal end of the central leg member as a lock foot extending forwardly from the front face of the leg member. The lock foot is of stepped configuration having a first or a lowermost step and a second or uppermost step.

The front face of the housing has a generally square shaped pivot-opening therethrough, dimensioned so as to permit controlled passage of the shaped flange or pivot square on the right arm of the locking lever therethrough. The front face of the housing also has a generally rectangularly shaped opening which conforms to the shape and dimension of the hasp or lock ring. The front face of the housing has a notch cut preferably from a central portion of its lowermost edge. The notch cut along the central portion of the lowermost edge of the front face of the housing dimensionally conforms to the second or uppermost step of the lock foot.

The baseplate which surroundably engages the socket outlets has an arrangement of notches around its long lip portions, somewhat similar to that as described in the aforementioned '612 patent. The rear face of the housing preferably has three full size tabs extending rearwardly from its lower peripheral edge portion, for mating engagement with corresponding tab-receiving notches in the lip of the baseplate. The rear face of the housing also preferably has several slots to accommodate the electrical cord(s) or cable(s) which extend(s) from the male plug end of the power cord to the power consumer.

The procedure for assembling the lock lever within the housing is initiated by placing the lock lever on the inner side of the front face of the housing, angularly with respect to the lower peripheral edge thereof. The flange or pivot square is aligned with and passed through the square opening on the front face of the housing. The lock lever is then pivoted about its lever axis so that the pivot square flange is no longer in alignment with the square opening in that front face of the housing, thus preventing the lock lever's removal or displacement from the housing by someone without the proper means to do so. Once the left arm and the right arm are in general parallel alignment with the lower and upper edge of the front face of that housing, the hasp or lock ring may be pressed through the lock ring opening on the corresponding portion of the front face of the housing. The plug or male end of a power cord at this point, have already been inserted into the female slots on the plug receptacle within the baseplate, and the cords to those plugs extending through the slots in the rear wall of the enclosure, between the tabs extending therefrom. The rear tabs on the back wall of the housing also having been inserted into the corresponding notches on the rear edge of the baseplate with which they mate. The lower or first step on the lock foot is mated with a corresponding covered centrally located notch on the front lip of the baseplate with the upper or second step of the lock foot engaging in the notch on the lower edge of the front face of the housing. The centrally located notch is accessible only from a position within the housing enclosure, and not from outside the enclosure when the enclosure is secured onto the baseplate.

A locking device or a use-detection or monitoring or recording or alarm device may be inserted through the hasp or lock ring opening to keep the power cord safely and tightly secured or monitored or tamper alarmed within the housing enclosure and the respective electrical outlet. To remove or unplug an electrical cord within the housing, the "use device" or locking device would be removed from the lock ring opening and the hasp lock ring would be biased rearwardly by pressure on that hasp by a user. Such rearward pressure on the lock lever would correspondingly move the lock foot rearwardly towards the center of the housing from the covered central notch, so as to remove the lock foot first step from its restrained position in that respective notch within the lip of the baseplate.

Thus, the enclosure housing with the power cord already there-attached therewithin, may be unlocked by the locking lever being manually biased rearwardly once the locking or sensing device has been removed.

In a further embodiment, a slightly hingedly flexible securement strap may be arranged between a sidewall of the enclosure housing and an end wall of the baseplate. This strap prevents the enclosure housing from being lost or misplaced during an assembly or during non-use of the inventive arrangement. The strap may consist of a first leg of which is secured to the end wall of the enclosure housing, the strap having a second leg with a generally "J" shaped distal end which is arranged to be received within a notch on the lower edge of the baseplate. The strap is preferably flexible enough to hold the enclosure housing away from the baseplate while an electrical cord is being inserted or removed therefrom. The strap also however does not interfere with the engagement and disengagement of the tabs on the rear wall of the housing or with the engagement and disengagement of the lock foot from the baseplate.

The present invention also preferably comprises a security monitor which is utilizable for the maintenance of the enclosure housing in a secure and monitored fashion. The security monitor, in one preferred embodiment, has a generally cylindrically shaped attachment pin which is arranged to be passed through the opening or hole in the distal end of the hasp extending through the front face of the enclosure housing. The attachment pin is attached to an elongated monitor housing. The elongated monitor housing encloses a proper circuit which is in communication with one or more depressible biased signal generating protrusions extending radially outwardly from the attachment pin. The biasedly movable protrusions are connected to the circuit which includes a current-flow-sensor computer. Depression or actuation of the proper signal generating switches/protrusions permits the installation and removal of the attachment pin through the opening on the distal end of the hasp or locking tab in the front wall of the housing, and movement of the protrusions preferably also actuates the sensor monitor. The proper circuit for the sensor monitor may also preferably include a current flow sensor or timer, a plurality of code input switches/buttons, a sound and/or light generator and a liquid crystal display screen.

The security monitor is utilized, for example, when a plug and cord is set in the enclosure housing and the security monitor is set in place. If the plug were removed from the outlet and that plug was intended to supply electrical service to a significantly important power consumption device such as a refrigerator or the like, where electrical service or products electrically connected thereto had to be maintained in a lower temperature or condition, the monitor would indicate an interruption in that electrical service by virtue of an alarm being tripped, a radio signal being sent therefrom, or a light indicating such power being at least temporarily disabled, or a use of that plug-in circuitry interrupted in some manner or another.

A further aspect of the present invention is shown wherein the enclosure housing has an open upper surface thereof, which permits a larger than usual or larger than typical plug to be inserted within an outlet with the plug's cable being passed through a side opening (which side opening is smaller than the diameter of the plug) on that enclosure housing. The enclosure housing being secured to the baseplate prevents the plug from accidently falling out while still allowing the removal of that plug from the outlet while still being retained within the enclosure housing. The narrow opening on the side wall of the enclosure housing being smaller than the diameter of the plug, thus secures the plug within the still attached enclosure housing/baseplate combination, while preventing it from being lost or unreachable.

The invention thus comprises a securement housing arrangement for attachment to a baseplate frame arrangement having electrical outlets arranged therewithin, to protect and permit the control and the use of electrical plugs in those outlets and power cables with respect to that securement housing, comprising: a wall of the housing having at least one opening for the passage of a power cable therethrough; a biasable locking lever arranged on a wall of the housing so as to secure the housing to a base plate frame arrangement, and to permit that locking lever to be controllably secured to that enclosure housing. The biasable locking lever is preferably arranged on the inside of the housing. The biasable locking lever is preferably of "T" shape, having a longitudinally aligned first arm and a second arm, the first arm having a pivot axis extending on an end thereof which pivot axis extends through a shaped opening in the front wall of the housing. The pivot axis preferably has a flange or pivot square on a distal end thereof. The opening in the front wall of the housing is of a square shape and is in corresponding size with the flange or pivot square on the distal end of the pivot axis. The locking lever has a lower foot which engages a notch in a base plate frame thereadjacent. The second arm as a hasp extending therefrom, which hasp extends through a slot on the front wall of the housing, the hasp having a lock ring opening therein. Inward displacement of the hasp through the slot on the front wall of the housing effects inward displacement of the lower foot and its withdrawal from the notch in the base plate frame to which the housing is secured. A combination or keyed lock or securement device may be arranged through the lock ring opening in the hasp. The securement device may in one embodiment comprise a sensor circuit for monitoring interruption or removal of an electrical plug from an outlet within the base plate. A retention strap may be connected between the housing and the baseplate to prevent inadvertent separation and loss thereof.

The housing in one embodiment, preferably has an uppermost wall surface with an opening there through, to permit comparatively or unusually large plugs and their associated cords to be retained within the location of outlet covered by that housing. The housing, secured to the baseplate, may have a sidewall opening through which the cord of the large plug extends, the sidewall opening in the wall of the housing being of smaller diameter than the diameter of the comparatively large plug enclosed within the housing, thus keeping the power cord from leaving the area of the sockets to which they are or were attached.

The invention also comprises a method for controlling the use of an electrical outlet base plate arrangement comprising: placing enclosure housing into an articulable notched arrangement within the electrical outlet base plate arrangement; securing a biasable locking lever into a wall of the enclosure housing; engaging a foot of the locking lever into a covered notch on a frame portion of the electrical outlet baseplate arrangement; extending a hasp through a wall of the enclosure housing; and placing a securement device through an opening on the hasp extending through the wall of the housing, so as to permit the locking of the housing to the outlet baseplate arrangement or to monitor and/or record the use or misuse of that electrical outlet; removing the secure device from the hasp extending through the wall of the housing, so as to permit the insertion of or removal of an outlet plug from an electrical outlet within the enclosure housing; wherein the securement device may include a timer to monitor or trigger a signal/alarm for the period of time when or how long an electrical plug may have been removed from an electrical outlet within the housing; and the step of pushing the biasable lever inwardly at the distal end of the hasp so as to remove the foot of the locking lever from the notch in the base plate frame arrangement.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 1:
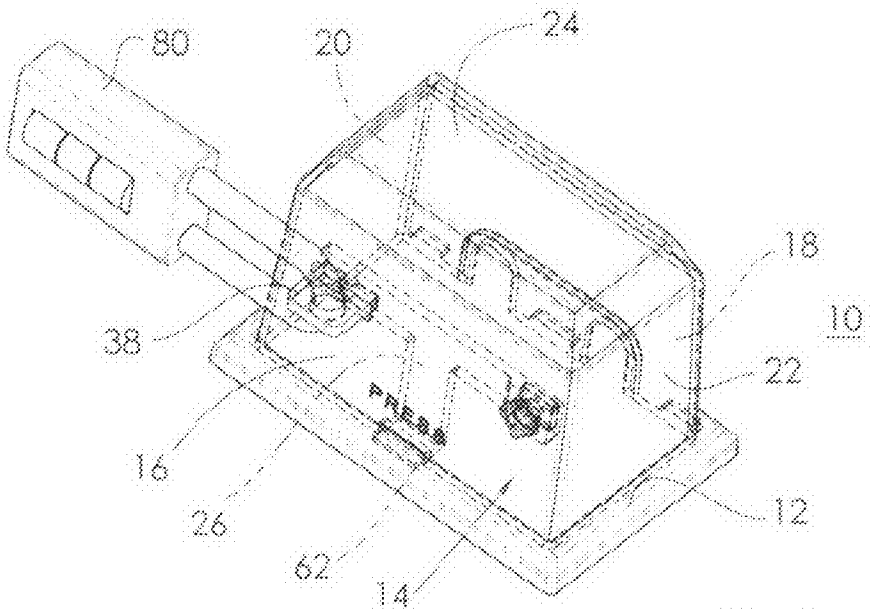
FIG. 1 is a perspective view of the enclosure housing mated with a base plate frame constructed according to the principles of the present invention.

Referring now to the drawings in detail, and particularly to FIG. 1, there is shown the present invention which comprises a housing or enclosure arrangement 10 for an electrical outlet base plate and frame arrangement 12 so as to permit the safe control over its use and to prevent the misuse thereof. The housing or enclosure arrangement 10 comprises a preferably rectilinear, unitary housing 14, having a front wall 16, a rear wall 18, a left wall 20 and a right side wall 22 and an uppermost (roof) surface 24. The housing 14 of the present invention has inwardly displaceable, generally "T" shaped locking lever 26 arranged to secure the housing 14 to the electric outlet framed baseplate 12.

Figure 2:
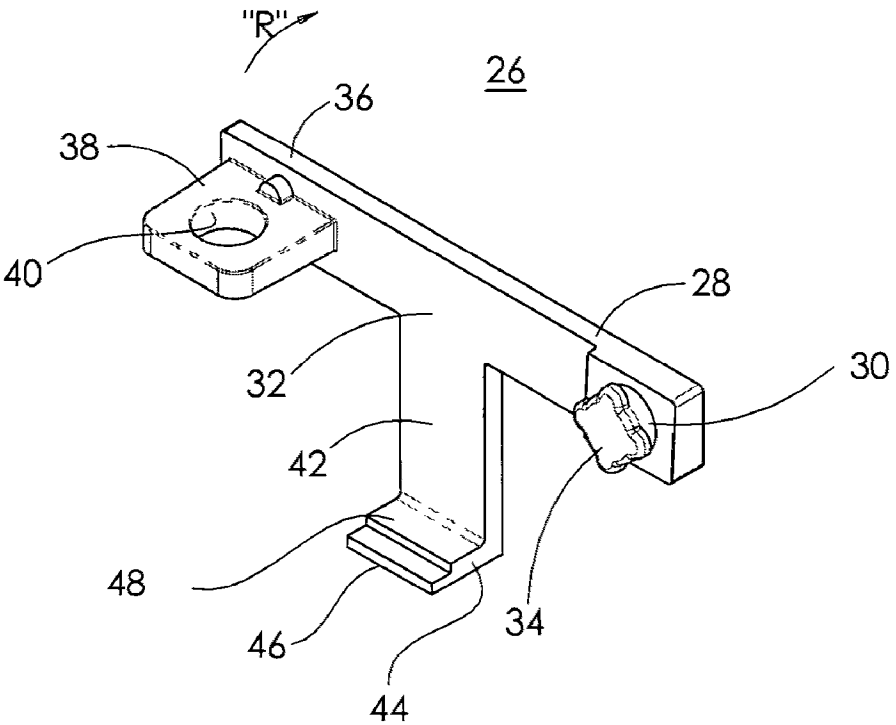
FIG. 2 is a perspective view of a generally "T" shaped locking lever, constructed according to the principles of the present invention.
Figure 3:
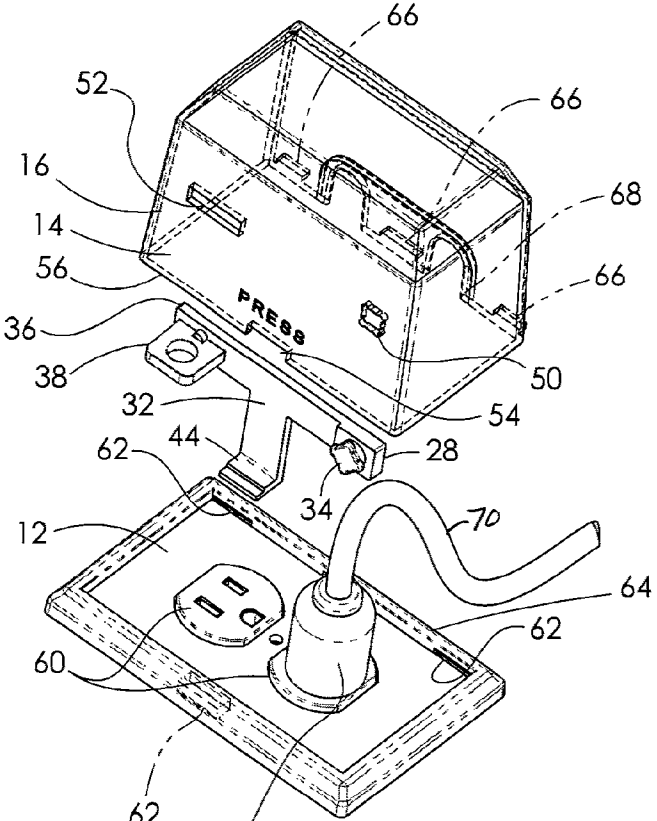
FIG. 3 is an exploded view of the baseplate, the locking lever and the enclosure housing.
Figure 4:
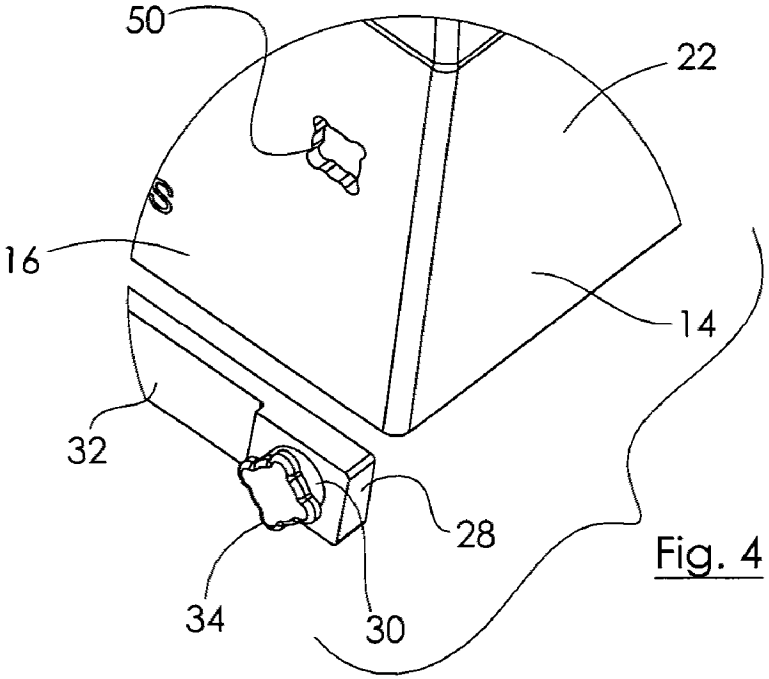
FIG. 4 is an enlarged view, in perspective, of the right arm of the locking lever and its respective flange or pivot square prior to its angled insertion into the generally square shaped obliquely oriented opening on the front face of the housing.

The generally T-shaped locking lever 26, as may be seen in FIGS. 1, 2 and 3, has a right arm 28 with a lever axis 30 extending from a front face 32 thereof. A flange-like pivot square 34 is fixedly attached to the distal end of the lever axis 30, as best shown in FIGS. 2 and 4. The locking lever 26 has a left arm 36 with a hasp or lock ring 38 extending from the front face 32 thereof. The lock ring 38 has a lock or control device-receiving bore 40 extending therethrough. The locking lever 26 has a central leg member 42 extending generally perpendicularly from the left arm 36 and the right arm 28, best seen in FIG. 2. The lower or distal end of the central leg member 42 has a lock foot 44 extending forwardly from the front face of the leg member 42. The lock foot 44, as best seen in FIG. 2, is of stepped configuration having a first or a lowermost step 46 and a second or uppermost step 48, of greater thickness than the first step 46.

As shown in FIG. 3, the front face 16 of the housing 14 has a generally square shaped opening 50, which opening 50 is dimensioned so as to permit controlled insertable passage of the flange-like pivot square 34 on the right arm 28 of the locking lever 26 therethrough, for retention therein. The front face 16 of the housing 14 also has a generally rectangularly shaped opening 52 which conforms to the cross-sectional shape and dimension of the hasp or lock ring 38. The front face 16 of the housing 14 preferably has a notch 54 cut from a central portion of its lowermost edge 56, as best shown in FIG. 3. The notch 54 cut along the central portion of the lowermost edge 56 of the front face 14 of the housing 16 dimensionally conforms to the second or uppermost step 48 of the lock foot 44, represented in FIG. 2.

Figure 5:
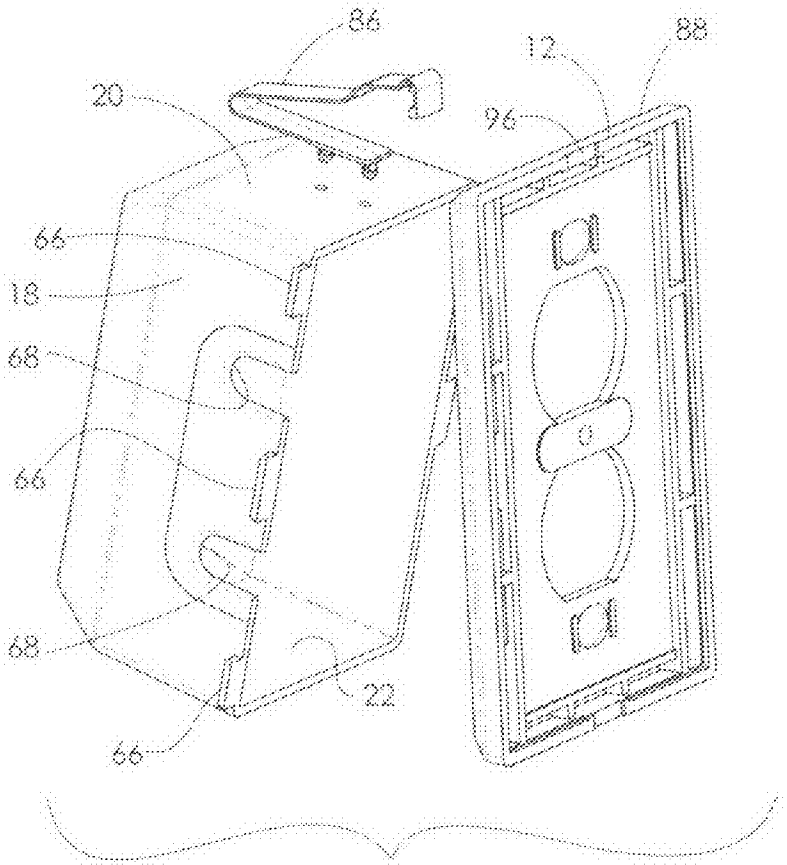
FIG. 5 is a perspective view of the enclosure housing with a securement strap thereon ready to engage that housing and to engage a notch in one end of the baseplate.

The exploded view of FIG. 3 shows the baseplate frame arrangement 12 which surroundably engages the socket outlets 60, having an arrangement of notches 62 around at least one long side of its long lip portions 64, somewhat similar to that as described in the aforementioned '612 patent. The rear face 18 of the housing 14 preferably has three full size tabs 66 extending from its lower peripheral edge portion, for mating engagement with corresponding tab-receiving notches 62 in a corresponding edge of the lip of the baseplate 12. The rear face 18 of the housing 14 also preferably has several slots 68, as best represented in FIG. 5, to accommodate the electrical cord or cable 70 which extends from the male plug end 72 of the power cord, to the power consumer.

The procedure for assembling the lock lever 32 within the housing 14 is initiated by placing the front side 32 of the lock lever 26 against the inner side of the front face 16 of the housing 14, disposed angularly with respect to the lower peripheral edge 56 thereof. The flange or pivot square 34 is passed through the "skewed" square opening 50 on the front face wall 16 of the housing 14. The lock lever 32 is then pivoted about its lever axis 30 so that the pivot square 34 is no longer in alignment with the square opening 50 in that front face wall 16 of the housing 14, that is, the square 34 and the opening 50 are now in misalignment with one another. Once the left arm 36 and the right arm 28 are in general parallel alignment with the lower edge 56 of the front face wall 16 of that housing 14, the lock ring 38 may be pressed through the lock ring opening 52 on the corresponding portion of the front face wall 16 of the housing 14. The plug or male end 72 of a power cord may be inserted into the female slots on the plug receptacle 60 within the baseplate 12. The rear tabs 66 on the back wall 18 of the housing 14 may then be inserted into the corresponding notches 62 on the rear edge lip 64 of the baseplate 12 with which they mate. The lower or first step 46 on the lock foot 44 may be mated with the corresponding centrally located "covered" (accessible only from the inside of the housing 14) notch 62 on the mid point of the front lip 64 of the baseplate 12, as represented in FIGS. 1 and 3, with the upper or second step 48 of the lock foot 44 engaging the notch 54 on the lower edge 56 of the front face wall 16 of the housing 14.

Figure 10:
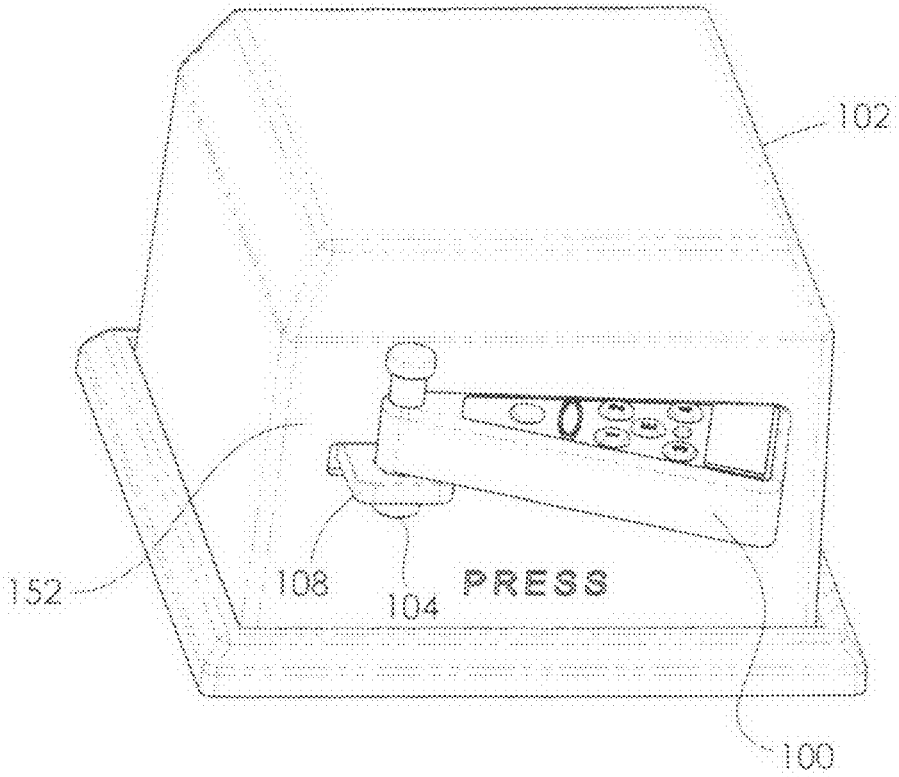
FIG. 10 is a perspective view of the assembled components shown in FIG. 9.
Figure 11:
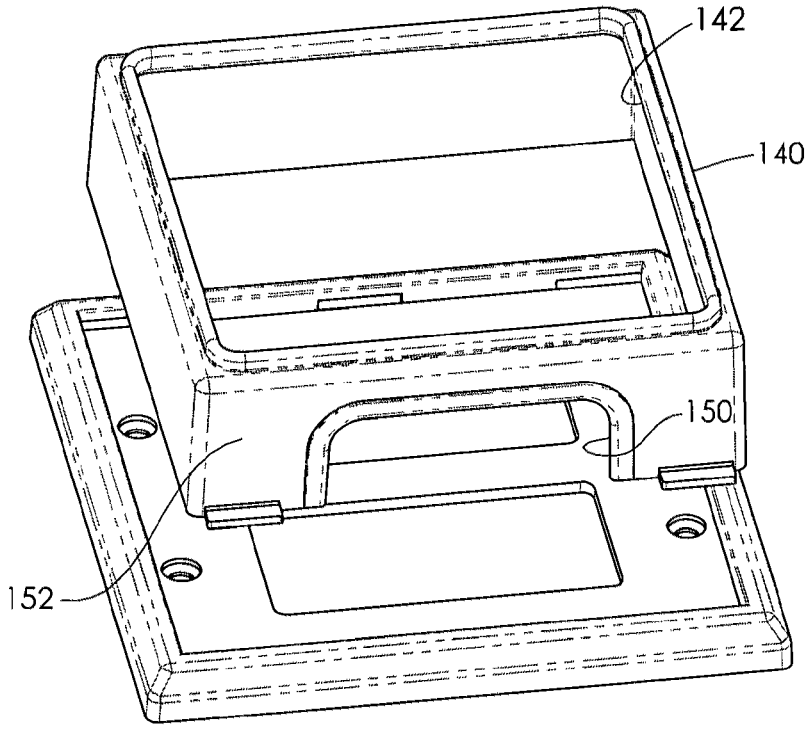
FIG. 11 is an exploded view of a base plate and a further embodiment of a lockable enclosure housing with an open upper surface thereon.

A "locking" device or a "use-detection" device 80 or 100, may be inserted through the hasp 38 and 108, as represented respectively in FIGS. 1 and 10, to keep the power cord safely and tightly secured within the housing enclosure 14 and its respective electrical outlet 60. To remove or unplug an electrical cord/plug 70/72 within the housing 14, the "use device" or locking device 80 or 100 would be removed from the lock ring opening 40 and the lock ring 38 or 108 would be biased rearwardly "R" by pressure from a user, as represented in FIG. 2. Such rearward pressure on the lock lever 32 would also, correspondingly move the lock foot 44 rearwardly towards the center of the housing 14 so as to effect the rearward movement of the lock foot 44, and hence remove the lock foot first step 46 from its respective notch 62 within the mid-point of the lip 46 of the baseplate 12.

Thus, the enclosure housing 14 with the power cord plug 72 already thereattached therewithin, may be unlocked by the locking lever 26 being manually biased rearwardly as indicated by the arrow "R" in FIG. 2, once the locking or sensing device 80 or 100 has been removed.

Figure 7:
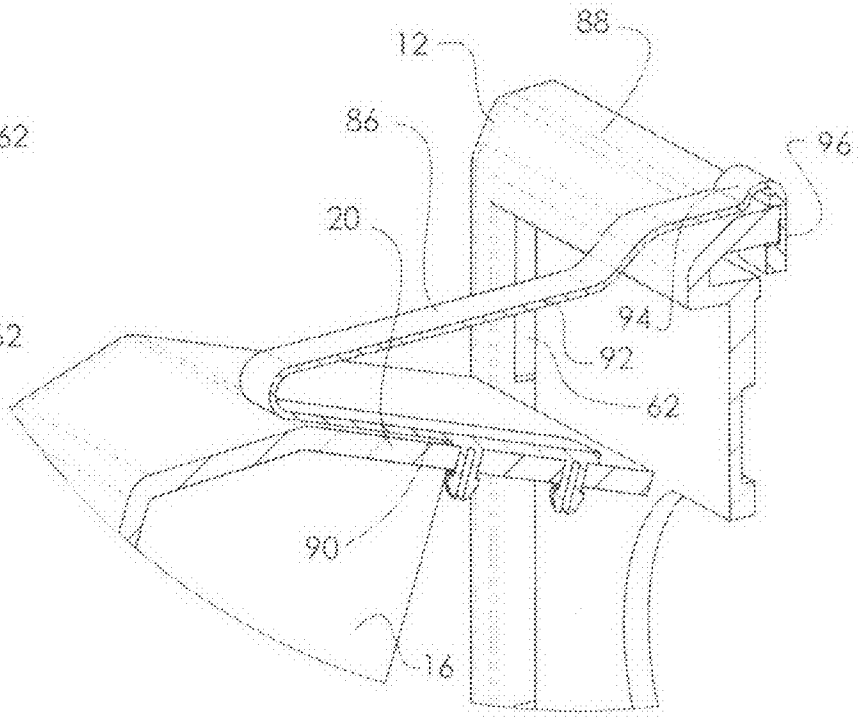
FIG. 7 is a perspective view, in section, of a portion of the enclosure housing, mated with the securement strap, to the end portion of the baseplate.
Figure 6:
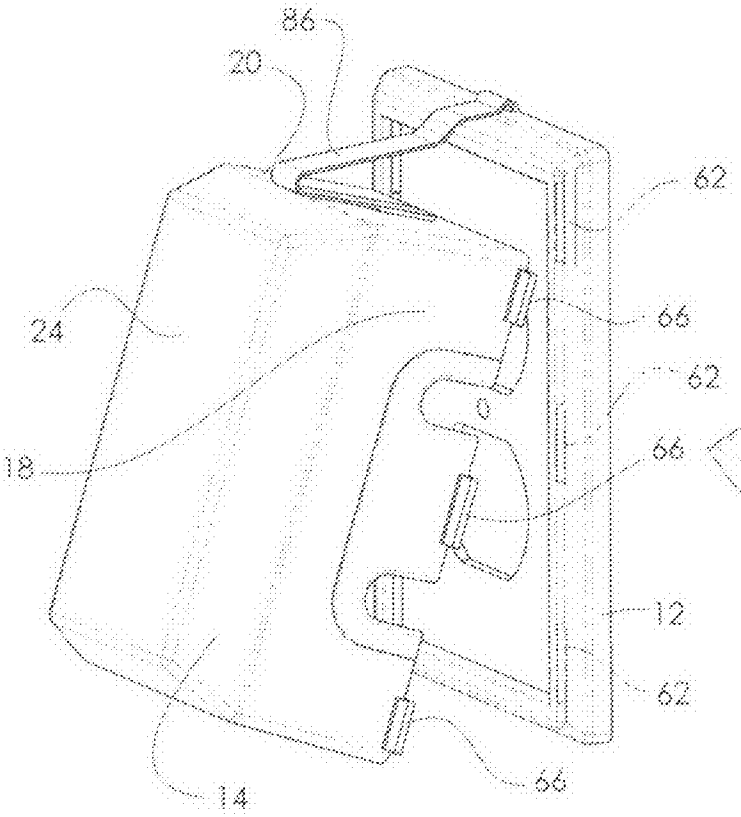
FIG. 6 is a perspective view of the enclosure housing, the baseplate and the securement strap in a pre-engagement orientation.

FIGS. 5, 6 and 7 display a slightly flexible securement strap 86 which may be arranged between a sidewall 20 of the enclosure housing 14 and an end wall 88 of the baseplate 12. This retention strap 86 prevents the enclosure housing 14 from being lost or misplaced during an assembly or non-use of the inventive arrangement. The strap 86 may consist of a first leg 90 of which is secured to the end wall 20 of the enclosure housing 14, the strap 86 having a second leg 92 with a generally "J" shaped distal end 94 which is arranged to be received within a notch 96 on the lower edge of the baseplate 12. The strap 86 is flexible enough to hold the enclosure housing 14 away from the baseplate 12 while an electrical cord plug 72 is being inserted or removed therefrom. The strap 86 also however does not interfere with the engagement and disengagement of the tabs 66 on the rear wall 18 of the housing 14 or with the engagement and disengagement of the lock foot 44 from the baseplate 12.

Figure 8A:
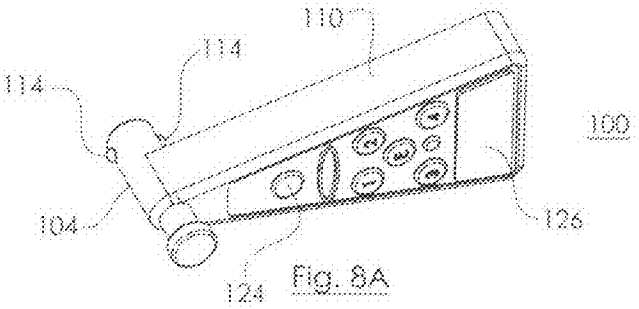
FIG. 8A is a perspective view of a security monitor for use with the enclosure housing.
Figure 8B:
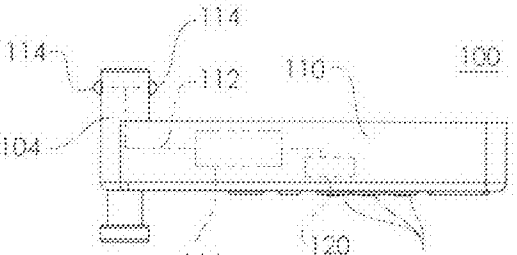
FIG. 8B is a side elevation of view of the right side of the security monitor shown in FIG. 8A.
Figure 8C:
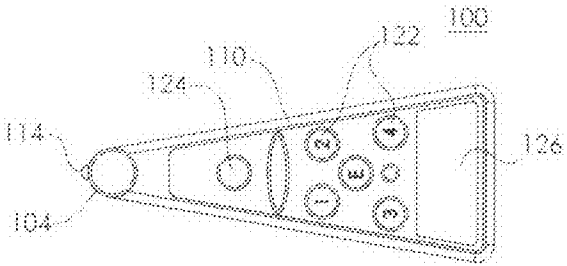
FIG. 8C is a plan view of the security monitor shown in FIG. 8A.
Figure 9:
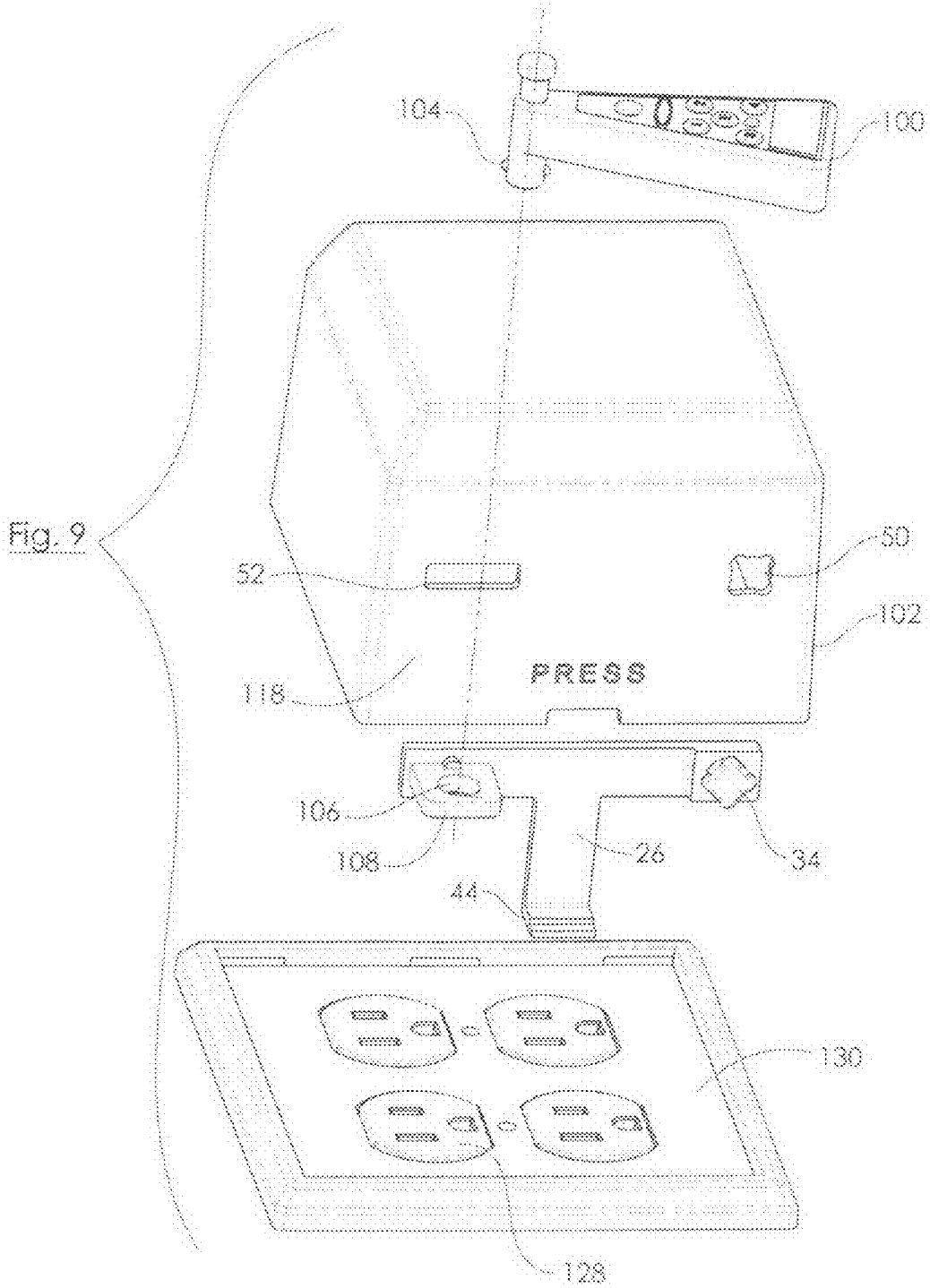
FIG. 9 is an exploded view of the enclosure housing in association with the base plate and the securement arrangement and the security monitor.

The present invention also comprises a security monitor 100, shown for example, in FIGS. 8A, 8B and 8C, which security alarm/monitor/signal generator 100 is utilizable for the maintenance of an enclosure housing 102, as also represented in FIGS. 9 and 10, in a secure and monitored fashion. The security monitor 100 has a generally cylindrically shaped attachment pin 104 which is arranged to be passed through an opening or hole 106 in the distal end of the hasp 108 extending through the front face of the enclosure housing, as represented in FIGS. 9 and 10. The attachment pin 104 is attached to an elongated monitor housing 110. The elongated monitor housing 110 encloses a proper circuit 112 which is in communication with one or more depressible biased switch-like protrusions 114 extending radially outwardly from the attachment pin 104, as represented in FIG. 8B. The biasedly movable protrusions 114 are connected to the circuit 112 which circuit 112 preferably includes an empowered, current-flow-sensor computer 116. Depression of the switches or biased protrusions 114 permits the installation and removal of the attachment pin 104 through the opening 106 on the distal end of the hasp or locking tab 108 in the front wall 118 of the housing 102, as represented in the "exploded" view represented by FIG. 9, and movement or actuation of the protrusions 114 preferably also actuates the sensor monitor 100. The sensor monitor 100 also preferably includes a current flow sensor or timer 120, a plurality of code input switches or buttons 122 connected to the proper circuit 112, a sound and/or light or wireless rf signal generator 124 and/or a liquid crystal or LED display screen 126.

The security monitor 100 is utilized, for example, when a plug and cord is set in the enclosure housing and the security monitor is set in place, not shown for clarity of the figures. If the plug were removed from the outlet 128 within a base plate 130, and that plug was intended to supply electrical service to a significantly important power consumption device such as a refrigerator or the like where products inside/conditions had to be maintained in a lower temperature, the monitor 100 would indicate an interruption in that electrical service by virtue of an alarm being tripped, or a light/rf signal indicating such power being at least temporarily disabled, or a use of that plug-in circuitry interrupted in some manner or another. The monitor is preferably arranged to log the time and duration of a power interruption.

Figure 12:
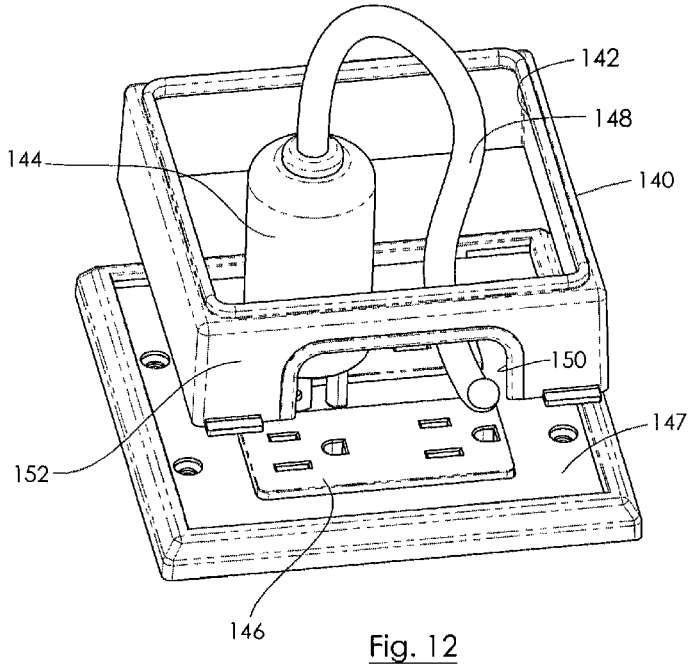
FIG. 12 is a view of the "open" lockable housing similar to FIG. 11, shown with a plug and cable in an exploded presentation.
Figure 13:
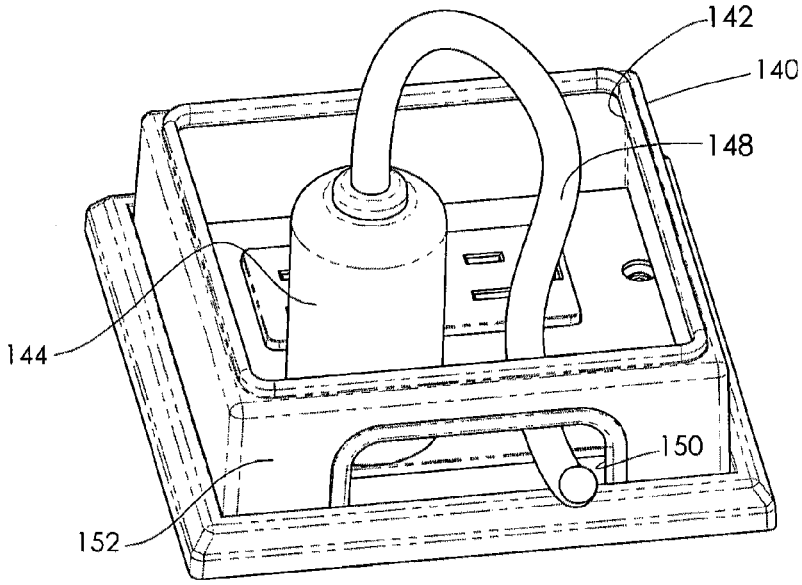
FIG. 13 is a perspective view of the housing, plug, cable and base plate assembled, which are represented in FIG. 12.
Figure 14:
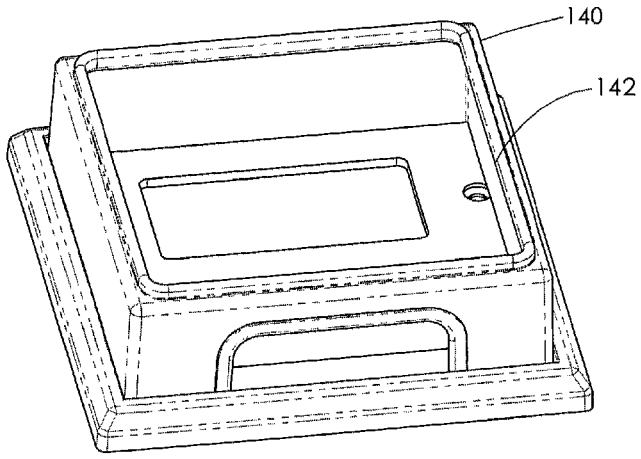
FIG. 14 is a perspective view of the base plate and open enclosure housing shown in FIG. 13, without the plug and cord thereattached.

A further aspect of the present invention is represented for example, in FIGS. 11, 12, 13 and 14, wherein an enclosure housing 140 has an open upper face 142 thereof, which permits a larger than usual plug 144 to be inserted within an outlet 146 with the plug's cable 148 being passed through a preferably rectilinearly shaped narrow side opening 150 on that enclosure housing 140, as best represented in FIGS. 12 and 13. Removal of that plug 144 from the outlet 146 within a baseplate 147, while still being safely and securably retained within the enclosure housing 140, is thus permitted. The narrow opening 150 on the side wall 152 of the enclosure housing 140 is preferably smaller than the diameter of the plug 144, thus securing the plug 144 within the enclosure housing 140 while preventing it from being lost or unreachable.

The invention claimed is:

1. A securement enclosure housing arrangement for attachment to a base plate frame having electrical outlets arranged therewithin, to enclosably protect, permit the monitoring of, and/or control the use of electrical plugs in those outlets and power cables with respect to the securement enclosure housing arrangement, the housing arrangement having a front wall, a back wall, side walls and an uppermost wall, comprising;

a first wall of the enclosure housing having at least one opening for a passage of at least one power cable therethrough;

a biasable locking lever arranged on a second wall of the enclosure housing, the locking lever comprising a rearwardly displacable hasp and a locking foot combination so as to permit the securement of the enclosure housing to the base plate frame arrangement, and wherein the locking lever is controllably secured to the enclosure housing by an electronic security monitor device, the electronic security monitor device including an alarm/monitor/signal generator which is removably arranged through the distal end of the displacable hasp.

2. The securement enclosure housing arrangement as recited in claim 1, wherein the biasable locking lever is arranged on an inside of the housing.

3. The securement enclosure housing arrangement as recited in claim 2, wherein the biasable locking lever is of "T" shape, having a first arm and a second arm, the first arm having a pivot axis extending therefrom which pivot axis of the locking lever extends through an opening in the front wall of the housing.

4. The securement enclosure housing arrangement as recited in claim 3, wherein the pivot axis of the locking lever has a flanged pivot square on the distal end thereof.

5. The securement enclosure housing arrangement as recited in claim 4, wherein the opening in the front wall of the housing is of a square shape and is in corresponding size with the pivot square on the distal end of the pivot axis.

6. The securement enclosure housing arrangement as recited in claim 3, wherein the foot of the locking lever engages a notch in the base plate frame thereadjacent.

7. The securement enclosure housing arrangement as recited in claim 6, wherein the hasp extends from the second arm, and wherein the hasp has a distal end which extends through a slot on the second or front wall of the housing, the hasp having a lock ring opening therein on the distal end thereof.

8. The securement enclosure housing arrangement as recited in claim 7, wherein an inward displacement of the hasp through the slot on the front wall of the housing effects inward displacement of a lower foot and its withdrawal from the notch in the base plate frame to which the enclosure housing is secured.

9. The securement enclosure housing arrangement as recited in claim 7, wherein the security monitor device is arrangable through the lock ring opening in the hasp.

10. The securement enclosure housing arrangement as recited in claim 9, wherein the security monitor device comprises a sensor circuit for monitoring the tampering or an interruption in an electrical circuit of one of the electrical plugs within the base plate outlet.

11. The securement enclosure housing arrangement as recited in claim 1, wherein a retention strap is connected between the housing and the base plate to prevent inadvertent separation and loss of the housing from the base plate.

12. The securement enclosure housing arrangement as recited in claim 1, wherein the housing has the uppermost wall surface with an opening there through, to permit comparatively large plugs and their associated cords to be retained within the outlet covered by the housing.

13. The securement enclosure housing arrangement as recited in claim 12, wherein the housing has the opening through the uppermost wall which the cord of the large plug extends, the opening in the uppermost wall of the housing being of smaller diameter than the diameter of the comparatively large plug enclosed within the housing.

14. A method for controlling the use of an electrical outlet base plate arrangement comprising:

forming an enclosure housing for enclosable attachment to an electrical outlet base plate and an electrical outlet therewith, the housing having a front wall, a rear wall, a pair of side walls and an uppermost wall;

placing an array of tabs disposed on the rear wall of the enclosure housing into mating engagement with a corresponding arrangement of notches within an adjacent lip edge of the electrical outlet base plate arrangement;

securing a biasable locking lever into the front wall of the enclosure housing;

engaging a foot of the locking lever into a notch on a front lip edge portion of the electrical outlet base plate arrangement;

extending a hasp through the front wall of the enclosure housing when the foot of the locking lever engages its corresponding notch on the front lip edge portion of the base plate arrangement; and placing a security monitoring device through an opening on the hasp which extends through the front wall of the housing, so as to permit the locking of the housing to the outlet base plate arrangement and to electronically monitor and record any removal of the security monitoring device or misuse of the electrical outlet, as shown by the electronically sensed and recorded removal of the monitoring device from the hasp.

15. The method for controlling the use of the electrical outlet base plate arrangement as recited in claim 14 comprising;

removing the security monitoring device from the hasp extending through the front wall of the housing, so as to permit the insertion of or removal of the outlet plug from the electrical outlet within the enclosure housing.

16. The method for controlling the use of the electric outlet base plate arrangement as recited in claim 15, including:

pushing the biasable lever inwardly at the distal end of the hasp so as to remove the foot of the locking lever from the notch in the base plate frame arrangement.

17. The method for controlling the use of the electrical outlet base plate arrangement as recited in claim 14, wherein the security monitoring device includes a timer to monitor the period of time when an electrical plug may have been removed from the electrical outlet within the housing.

18. The method as recited in claim 17, including:

sending a wireless alarm signal upon the removal of the security monitoring device from the enclosure housing.

* * * * *